United States Patent [19]

Jeffries

[11] 4,143,877

[45] Mar. 13, 1979

[54] GOLFER'S TRAINING DEVICE

[76] Inventor: Alfred J. Jeffries, 24525 Rensselaer, Oak Park, Mich. 48237

[21] Appl. No.: 803,527

[22] Filed: Jun. 6, 1977

[51] Int. Cl.[2] ..... A63B 69/36

[52] U.S. Cl. ..... 273/183 E; 33/286

[58] Field of Search ..... 273/35 A, 183 E, 190 R, 273/190 A, 183 R; 35/26; 219/461; 124/87; 33/264, 286

[56] References Cited

U.S. PATENT DOCUMENTS

| | | | |
|---|---|---|---|
| 1,231,196 | 6/1917 | Rankin et al. | 219/461 |
| 1,410,811 | 3/1922 | Lewis | 273/35 A |
| 2,754,599 | 11/1951 | Stieber | 124/87 X |
| 3,468,545 | 9/1969 | Anderson | 273/183 E |
| 3,524,650 | 8/1970 | Brandell | 273/183 E |
| 3,622,159 | 11/1971 | Morton | 273/183 E |
| 3,915,457 | 10/1975 | Casey | 273/183 E |
| 3,917,278 | 11/1975 | Steinman | 273/183 E |
| 3,953,033 | 4/1976 | Kelly | 273/183 E |
| 4,001,941 | 1/1977 | Cruz | 35/26 X |
| 4,008,528 | 2/1977 | Caulfield | 35/26 |

FOREIGN PATENT DOCUMENTS

| | | | |
|---|---|---|---|
| 430844 | 6/1935 | United Kingdom | 273/183 E |

*Primary Examiner*—George J. Marlo

*Attorney, Agent, or Firm*—Harness, Dickey & Pierce

[57] ABSTRACT

There is disclosed herein a golfer's training device particularly adapted for use in indicating head movement during the execution of a golf swing through utilization of the parallax principle. The training device comprises a target containing member supported upon a base member, the target member having a sighting object supported in a spaced relationship thereto so as to be alignable with a portion of a target provided on the target member as the golfer addresses a golf ball in preparation for a golf swing. In one form a base member is integrally molded with the target member and comprises a generally three-legged supporting structure. In another embodiment, the base member includes a spike projection extending downward from the lower portion of the target member which is adapted to be inserted into the ground so as to support the target member in proper relationship to a golfer as he is about to execute a swing. In this embodiment, a ground engaging base member is also provided for supporting the spike projection so as to enable the training device to be used indoors such as may be desired during winter months. The target containing member may be in the form of an upwardly facing arcuate surface having a grid-like network of lines thereon.

10 Claims, 7 Drawing Figures

GOLFER'S TRAINING DEVICE

BACKGROUND AND SUMMARY OF THE INVENTION

The present invention relates generally to devices for improving an individual's performance in a sporting activity and more specifically to a device for assisting an individual in preventing head movement during the execution of a golf swing by providing a means for readily ascertaining any such movement.

In the proper execution of a golf swing, it is extremely important that an individual maintain his head in a static position throughout the golf swing so as to insure proper contact between the club head and the ball. Most golfers experience a natural tendency to raise or otherwise move their head and in doing so change the relationship between their body, the club head and the ball. Very often, this head movement may be very slight such as may go unnoticed by the individual but yet still be sufficient to cause the golf ball to hook, slice or otherwise have a detrimental effect upon the distance and/or direction of travel thereof. Accordingly, various devices have been developed to assist the golfer by providing an indication of such movement.

One such device provides a relatively flat triangular shaped member comprising a lens having a plurality of indicators disposed therebelow, the lens being designed so as to allow viewing of only a single indicator at a time depending on the angle of viewing. In order to use this device, a golfer places the device on the ground adjacent the golf ball in such a position as to enable him to see a selected one of the indicators as he addresses the golf ball. Should he inadvertently move his head from this position during the backstroke or execution of the swing, the central indicator will appear to move out of sight and a second indicator may become visible. While this device may provide an adequate indication of head movement, the lack of any adjustable visual alignment means other than physically changing the position of the entire structure makes it inconvenient to use. Further, the lens member may require frequent cleaning as well as being easily broken should a wild swing bring the golf club into contact therewith.

Another such device of which applicant is aware comprises a housing which supports a retractable target means in a spaced relationship to a similarly retractable lens member having a single fixed dot which may be aligned with a portion of the target. In using this device, the golfer places the training aid on the ground adjacent the golf ball and positions it in such a manner as to allow him to visually align the dot provided on the lens with a portion of the target means. Head movement is indicated by apparent movement of the dot from its aligned position with the target portion. The target provided thereon comprises a vast number of intersecting horizontally and vertically extending lines making it difficult to be certain exactly which pair of intersecting lines has been aligned with the lens dot and therefore making use of this device a relatively arduous task at best. Further, the provision of a lens member, housing, and retraction mechanism results in a relatively expensive complex device. Also, should the golfer inadvertently position this training device too closely to the golf ball so as to be inadvertently nicked or otherwise hit, the lens member most certainly would be broken thus requiring costly replacement thereof.

Accordingly, the present invention provides an extremely simple golfer's training device which employs the parallax principle to provide a positive indication of even a slight movement of the head during a golf swing. More specifically, the present invention provides a sighting object supported in a spaced relationship to and which is visually aligned with a portion of a target surface so as to readily indicate head movement. Further, the present invention may be easily manufactured at a relatively low cost but yet produces a rugged durable training aid. The device is provided with three depending legs which afford a stable support means enabling the device to be utilized on virtually any type of surface. Further, as the target means includes a generally arcuate target surface, a wide degree of flexibility is provided as to the relative orientation of the surface to the golfer's line of sight.

Additional features and advantages of the present invention will become apparent from the subsequent description of the preferred embodiments and the appended claims taken in conjunction with the accompanying drawings.

DESCRIPTION OF THE PREFERRED EMBODIMENTS

Figure 1:
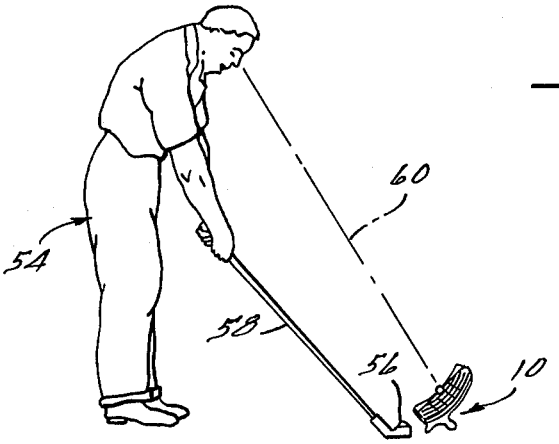
FIG. 1 is a perspective view of the present invention in operative relationship to a golfer addressing a golf ball.
Figure 2:
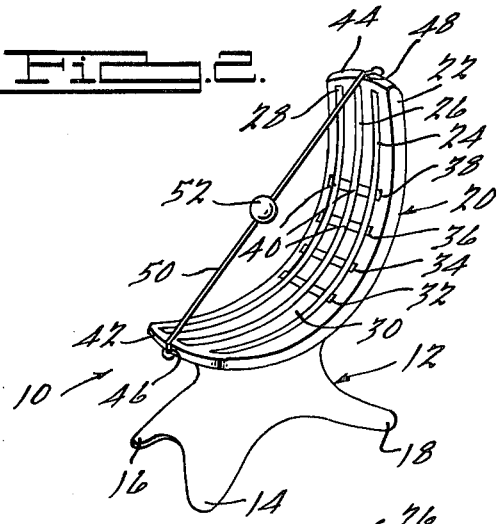
FIG. 2 is an enlarged perspective view of the present invention illustrated in FIG. 1.
Figure 3:
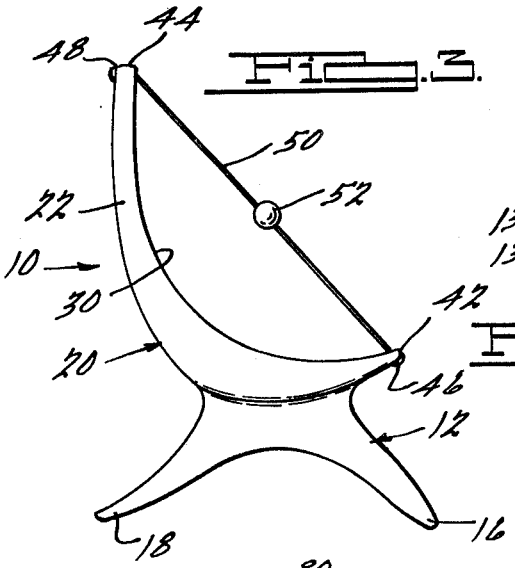
FIG. 3 is a side elevational view of the training device of the present invention.

Referring now to FIGS. 1 through 4, there is shown a golfer's training device indicated generally at 10 comprising a base member 12 having a generally irregular shape including three depending supporting legs 14, 16, and 18 associated therewith. Supported upon base member 12 is a target means 20 including a generally arcuate shaped target member 22 having a plurality of longitudinally extending lines 24, 26, and 28 provided on surface 30 thereof. A plurality of transversely extending lines 32, 34, 36, and 38 are also provided on surface 30 of target member 22 each of which intersects each longitudinally extending line 24, 26, and 28 at generally right angles thereto so as to form a plurality of spaced intersection points 40 thereon. As shown therein, the radius of curvature of the target member 22 is such as to place the opposite end portions 42 and 44 thereof in generally perpendicularly disposed planes. In this embodiment, each of end portions 42 and 44 are provided with relatively shallow slits 46 and 48 respectively therein. An elongated member 50 extends between and is disposed in respective of these slit members, the elongated member being in the form of a relatively thin wire or preferably a suitable monofilament synthetic fiber type material. The use of a monofilament line is preferred as it is very difficult to see from a distance and therefore minimizes the visual distraction from the target surface and sighting object. Elongated member 50 may be easily and tautly secured between end portions 42 and 44 in any suitable manner such as by providing the terminal end portions thereof with a knot so as to prevent member 50 from slipping out of slits 46 and 48 or by use of a suitable adhesive should this be desirable. A sighting object 52 preferably in the form of a sphere having a generally diametric opening through which elongated member 50 extends is also provided. Through experimentation it was found that a six millimeter sphere provided an extremely satisfactory sighting object which could be easily seen yet was not so large as to make it difficult to note its projected position on the target means.

As illustrated in FIGS. 1 through 4, target member 22 and base member 12 are integrally fabricated from a suitable plastic composition such as a polycarbonate material or preferably a polyurethane material for example. However, it should be noted that should it be desirable base member 12 and target member 22 may be integrally or even separately fabricated from any other suitable material. Also, elongated member 50 may be in the form of a flexible thread or filament or, should it be desirable, a relatively rigid rod member.

As best seen with reference to FIG. 1, a golfer 54 wishing to use golfer's training device 10 first places the device in a position immediately adjacent a golf ball 56 in such a position as to enable golfer 54 to view intersecting longitudinally and transversely extending lines provided on surface 30 of the target member 22. Golfer 54 may then assume a position addressing golf ball 56 with golf club 58 appropriately positioned in preparation for execution of a golf swing. Golfer 54 will then note the projected position of the sighting object upon the target means. As the target is displayed on a generally curved surface, wide flexibility is afforded as to the angle of incidence of line of sight 60 relative to surface 30 without any substantial distortion. This enables the golfer substantial flexibility in positioning the device with respect to the ball as well as with regard to the distance between him and the ball's position thus enabling him to not only vary his stance an/or swing but also to employ different clubs without repositioning of the device. This positioning flexibility is also important in facilitating the use of the device on uneven ground. Thereafter, golfer 54 may execute his swing and will be immediately appraised of any head movement as such movement will cause apparent movement of sighting object 52 out of line of sight 60. Thus, he is advised immediately of even the slightest movement of his head during the execution of his golf swing thereby enabling him to concentrate on overcoming this problem so as to improve his golf game.

It should also be noted that support leg 18 extends rearwardly substantially along the center line of the device and has a tapered end portion. This shape enables a golfer to easily use the device on virtually any surface including thick turf and sand without regard to the levelness thereof as leg 18 may be dug into the surface thereof such as the thatch layer of turf for example to provide additional support or stability. Further, should the circumstances require, leg 18 may be inserted directly into the ground so as to provide the sole support for the device.

Figure 5:
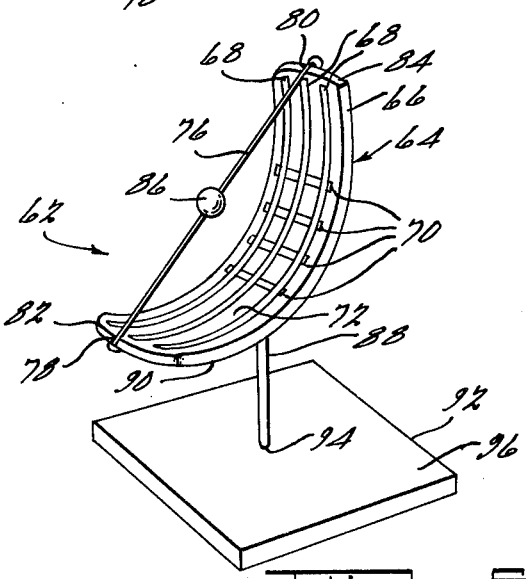
FIG. 5 is a perspective view of another embodiment of the present invention similar to that of FIG. 2 but employing a modified supporting means.

Referring now to FIG. 5, there is shown a slightly modified embodiment of the present invention indicated generally at 62 having a target member 64 substantially identical to the target means 20 described with reference to FIGS. 1 through 4 including a generally arcuate shaped target member 66 having a plurality of longitudinally 68 and transversely 70 extending generally perpendicularly intersecting lines provided on the face portion 72 thereof. An elongated member 76 is also provided which is secured within slots 78 and 80 disposed at opposite ends 82 and 84 of the target member 66 and having a sighting object 86 disposed thereon in spaced relationship to surface 72. However, in this embodiment, a base member in the form of a spike projection 88 is provided extending downwardly from the lower surface 90 of the target member 66. Spike projection 88 will preferably be of metal and is adapted to be inserted into the ground so as to support target member 66 in a suitable position as the golfer employs training device 62 out-of-doors. Additionally, a ground engaging base member 92 in the form of a generally rectangular block member is also provided having an opening 94 in the upper surface 96 thereof which is adapted to receive spike member 88 so as to support training device 62 should the golfer wish to practice indoors or in any other area in which the spike member cannot be inserted into a ground surface. Spike member 88 may be easily secured to target member 66 in any desired manner such as by means of a suitable adhesive or by embedding the upper end portion there in surface 90.

Figure 6:
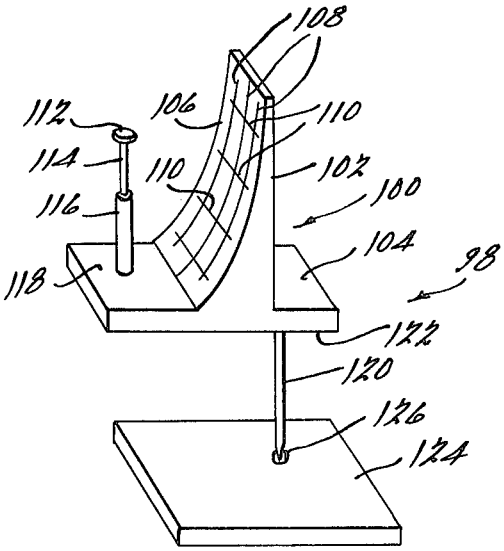
FIG. 6 is a perspective view of yet another embodiment of a training device in accordance with the present invention.

Yet another embodiment of the present invention is illustrated at 98 in FIG. 6 in which there is provided target means 100 comprising a target member 102 projecting generally upwardly from a generally horizontally extending platform portion 104. Target member 102 has a generally arcuate shaped front surface 106 which is provided with a plurality of longitudinally and transversely extending generally perpendicularly intersecting lines 108 and 110 respectively thereon similar to that described above. However, in this embodiment a sighting object 112 is affixed to one end of a movable member 114 which is telescopically received in a stationary lower member 116 which is secured to an upper surface 118 of the horizontally extending platform 104. Thus, in order to properly position sighting object 112 of training device 100, the golfer need merely move sighting object 112 up and down causing telescopic movement of the movable member 114 with respect to stationary member 116. In like manner to that described with reference to training device 62 of FIG. 5, training device 100 is also provided with a spike projection 120 extending downwardly from the lower surface 122 of generally horizontally extending platform 104 which may be inserted in the ground so as to support and position training device 100 with respect to the golfer as he is about to execute a golf swing. Also, a ground engaging base member 124 substantially identical to ground engaging base member 96 is provided having an opening 126 adapted to receive spike member 120 so as to enable the golfer to utilize this training device indoors or in other suitable hard surfaces which are not suitable for insertion of spike projection 120.

Figure 7:
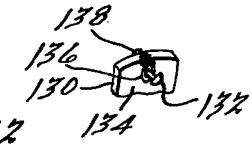
FIG. 7 is a view of a portion of another embodiment of the present invention similar to that of FIG. 1 but illustrating an alternate means for securing the sighting object support means.
Figure 4:
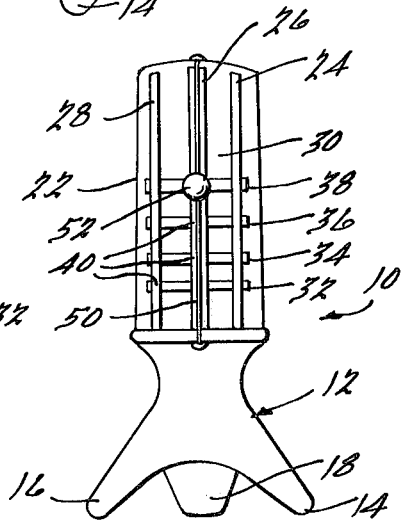
FIG. 4 is a front elevational view of the training device of the present invention.

An alternative means for securing elongated member 50 and/or 76 of the embodiments illustrated in FIGS. 1 through 5 described above is illustrated in FIG. 7. In this embodiment target means 130 is provided with an outwardly projecting stud member 132 on the back surface 134 thereof in place of slits 46 and 48 which is adapted to receive a loop 136 provided in elongated member 138. It will be understood that while only one end of target means 130 is illustrated, a second substantially identical stud member may also be provided adjacent the opposite end thereof which is similarly designed to receive another loop provided on elongated member 138. In order to assemble elongated member 138 to target means 130 one need merely hook a loop provided in one end of elongated member 138 over a stud 132 at one end of target means 130 then flex the two ends toward each other slightly to enable another loop provided at the other end to be hooked on another stud. The slight flexing during assembly will insure a tension is placed on elongated member 130 after assembly thereby keeping elongated member 130 taut during use.

Thus, as is apparent, there is disclosed herein a unique golfer's training device which is extremely durable and easy to use yet may be easily and inexpensively manufactured while still providing a positive easily readable indication of head movement during the execution of a golf swing.

While it is apparent that the preferred embodiments of the invention disclosed are well calculated to provide the advantages and features above stated, it will be appreciated that the invention is susceptible to modification, variation and change without departing from the proper scope or fair meaning of the subjoined claims.

I claim:

1. A training aid for golfers adapted to be positioned adjacent a golf ball comprising:

a base;

target means supported on said base and including a generally arcuate upwardly facing target surface having a plurality of intersecting lines provided thereon;

a sighting object; and an elongated support means having at least one end portion secured to a portion of said target means and supporting said sighting object in a spaced relationship with said generally arcuate surface, said sighting object being positioned with respect to said target surface so as to be visually alignable along the line of sight of a golfer addressing said adjacent golf ball, said training device being operative to indicate head movement of said golfer during execution of a golf swing.

2. A training aid as set forth in claim 1 wherein said base member and said target member are integrally formed from a plastic material.

3. A training aid as set forth in claim 1 wherein said target member includes first and second end portions disposed in generally perpendicular planes and said elongated support means comprise an elongated member extending between said first and second ends of said target member, said sighting object being disposed on said elongated member.

4. A training aid as set forth in claim 3 wherein said sighting object comprises a sphere having a diametric opening therethrough, said elongated member passing through said opening.

5. A training aid as set forth in claim 1 wherein said elongated member has another end secured to another portion of said target means with a portion intermediate said one and another ends being spaced from said target means.

6. A training aid as set forth in claim 5 wherein said support means comprises a monofilament line.

7. A training aid as set forth in claim 5 wherein said target means is provided with a stud projection adjacent each of said portion and said another portion and said elongated member is secured to said studs.

8. A training aid as set forth in claim 1 wherein said base includes a plurality of depending ground engaging legs.

9. A training aid as set forth in claim 8 wherein at least one of said legs is outwardly tapered so as to enable it to be inserted into a ground surface.

10. A training aid for golfers comprising:

a base member having a plurality of spaced depending ground engaging legs;

target means supported on said base and including an upwardly facing generally arcuate target surface;

an elongated member having opposite ends secured to opposite ends of said target means and an intermediate portion overlying said generally arcuate target surface; and a sighting object supported by said elongated member in a spaced relationship to said arcuate target surface, said sighting object cooperating with said generally arcuate target surface to provide an indication of head movement to a golfer.

* * * * *